United States Patent [19]

Mitsui et al.

[11] Patent Number: 4,948,962

[45] Date of Patent: Aug. 14, 1990

[54] PLASMA ION SOURCE MASS SPECTROMETER

[75] Inventors: Yasuhiro Mitsui, Fuchu; Satoshi Shimura, Kokubunji; Tsutomu Komoda, Tokyo, all of Japan

[73] Assignee: Hitachi, Ltd., Tokyo, Japan

[21] Appl. No.: 362,092

[22] Filed: Jun. 6, 1989

[30] Foreign Application Priority Data

Jun. 10, 1988 [JP] Japan ..... 63-141704

[51] Int. Cl.[5] ..... H01J 49/26

[52] U.S. Cl. ..... 250/288; 250/281; 250/289

[58] Field of Search ..... 250/281, 282, 288, 289

[56] References Cited

U.S. PATENT DOCUMENTS

| | | | |
|---|---|---|---|
| 4,144,451 | 3/1979 | Kambara | 250/289 |
| 4,501,965 | 2/1985 | Douglas | 250/288 |
| 4,682,026 | 7/1987 | Douglas | 250/288 |
| 4,740,696 | 4/1988 | Osawa et al. | 250/288 |
| 4,769,540 | 9/1988 | Mitsui et al. | 250/288 |

OTHER PUBLICATIONS

"Inductively Coupled Argon Plasma as an Ion Source for Mass Spectrometric Determination of Trace Elements", Houk et al., *Anal. Chem.*, 52, 1980, pp. 2283–2289.

"Use of the Microwave-Induced Nitrogen Discharge at Atmospheric Pressure as an Ion Source for Elemetal Mass Spectrometry", Wilson et al., *Anal. Chem.*, 59, 1987, pp. 1664–1670.

*Primary Examiner*—Bruce C. Anderson

*Attorney, Agent, or Firm*—Antonelli, Terry, Stout & Kraus

[57] ABSTRACT

Disclosed is a plasma ion source mass spectrometer comprising an ion source in which a sample to be detected is ionized in plasma and a mass spectrometer which mass-separates and detects the ionized sample supplied from the ion source, characterized in that there is provided a gas introduction means for introducing into a region before the mass spectrometer a gas containing particles which can bring about a charge transfer reaction with background ions contained in particles supplied from the ion source or a gas containing particles which can bring about an energy transfer reaction with excited molecule contained in the particles supplied from the ion source. By providing such gas introduction means, background ions or excited molecule can be efficiently quenched and enhancement of sensitivity of plasma ion source mass spectrometer can be attained.

22 Claims, 8 Drawing Sheets

PLASMA ION SOURCE MASS SPECTROMETER

BACKGROUND OF THE INVENTION

The present invention relates to a plasma ion source mass spectrometer and in particular to a plasma ion source mass spectrometer provided with a means suitable for quenching background ions which interfere with metal ions, quenching of such background ions being important for practical use thereof.

In conventional plasma ion source mass spectrometers, argon gas or nitrogen gas is used as a plasma gas and ions are produced by inductively coupled plasma (ICP) or microwave induced plasma (MIP), which are introduced into mass spectrometer and subjected to mass spectrometeric analysis. These devices are disclosed, for example, in "Bunseki (Analysis)", 1987, 7 (1987), pp. 480–484, "Anal. Chem.", Vol. 52, (1980), pp. 2283–2289, "Anal. Chem", Vol. 59, (1987), pp. 1664–1670, and Japanese Patent Application Kokai (Laid-Open) No. 62-219452.

Outline of plasma ion source mass spectrometers [ICP mass spectrometer (ICPMS) and MIP mass spectrometer (MIPMS)]is shown in FIG. 9. The object of them is normally to analyse ultra trace elements in a solid sample. The sample is dissolved in an acid or an organic solvent, the resulting liquid sample is fed to a nebulizer and thus nebulized sample is introduced into ionizing part 1 with a carrier gas such as argon or nitrogen. Plasma (ICP or MIP) is formed in plasma generating part 2 in the ionizing part 1 and the introduced sample is ionized in this plasma. Pressure in the plasma generating part is 1 atm. The ions produced in the plasma are introduced into mass analyzing part 5 of high vacuum through differential pumping regions 3,4 and separated according to mass to charge ratio (m/z, m: mass of ions and z: valency of ions) and then detected.

The above-mentioned conventional techniques give no consideration to quenching of background ions which are produced in plasma and which interfere with metal ions and this is a great problem for putting to practical use the ICP mass spectrometer (ICPMS) or MIP mass spectrometer (MIPMS). That is, in ICPMS which uses argon gas as a plasma gas, ions originating from argon as a main component and from nitrogen as an impurity and from acid and water used for making a sample in the form of aqueous solution which are introduced into ion source are produced as principal ions.

Amounts of these argon, nitrogen, acid and water introduced into ion source are much more than the amount of the trace elements to be analyzed in the sample simultaneously introduced into the ion source. Therefore, with reference to the ions produced in plasma, amount of ions originating from argon, nitrogen, acid and water is also much more than that of the ions of elements to be analyzed. Examples of ions originating from argon, nitrogen, acid and water are shown in Table 1 as background ions. There are many kinds of these background ions.

TABLE 1

| m/z | Background ions | Interfered elements |
|---|---|---|
| 28 | $N^{2+}$, $CO^{+}$ | $^{28}Si$ ($^{27}Al$) |
| 29 | $N_2H^{+}$, $COH^{+}$, $N^{15}N^{+}$ | $^{29}Si$ |
| 30 | $NO^{+}$ | $^{30}Si$ |
| 31 | $NOH^{+}$, $^{15}NO^{+}$ | $^{31}P$ |
| 32 | $O^{2+}$ | $^{32}S$ |
| 33 | $O^{17}O^{+}$ | $^{33}S$ |

TABLE 1-continued

| m/z | Background ions | Interfered elements |
|---|---|---|
| 34 | $^{17}O_2^{+}$, $O^{18}O^{+}$ | $^{34}S$ |
| 40 | $Ar^{+}$ | $^{40}Ca$ ($^{39}K$) |
| 41 | $ArH^{+}$ | $^{41}K$ |
| 48 | $SO^{+}$ | $^{48}Ti$ |
| 51 | $^{35}ClO^{+}$ | $^{51}V$ |
| 52 | $^{35}ClOH^{+}$ | $^{52}Cr$ |
| 53 | $^{37}ClO^{+}$ | $^{53}Cr$ |
| 54 | $ArN^{+}$ | $^{54}Cr$ $^{54}Fe$ |
| 56 | $ArO^{+}$, $N^{4+}$ | $^{56}Fe$ |
| 57 | $ArOH^{+}$ | $^{57}Fe$ |
| 64 | $SO_2^{+}$ | $^{64}Zn$ |
| 65 | $SO_2H^{+}$ | $^{65}Cu$ |
| 68 | $ArN_2^{+}$ | $^{68}Zn$ |
| 72 | $ArS^{+}$ | $^{72}Ge$ |
| 75 | $Ar^{35}Cl^{+}$ | $^{75}As$ |
| 77 | $Ar^{37}Cl^{+}$ | $^{77}Se$ |
| 80 | $Ar^{2+}$ | $^{80}Se$ |

These ions are those which do not originate from the sample and they are background ions. According to the conventional apparatuses, background ions and sample ions are introduced in admixture into the mass analyzing part and are subjected to mass-separation. Therefore, when background ions and sample ions have the same mass to charge ratio, the peak appearing at the position of that mass to charge ratio includes both the background ion peak and sample ion peak. Besides, since amount of the background ions is much more than that of sample ions, the appearing peaks are mostly for the background ions and considerably interfere with the sample ion peak and measurement becomes impossible. For example, if the element to be analyzed is Ca of mass to charge ratio (m/z) =40 as shown in Table 1, $Ca^{++}$ peak overlaps $Ar^{+}$peak which appears at the same m/z and in addition, since $Ar^{+}$peak is extremely higher than $Ca^{+}$peak, the peak appearing at m/z =40 is mostly for $Ar^{+}$ion as background ion and Ca to be analyzed cannot be detected. As shown in Table 1, there are many elements with which the background ions interfere. ICPMS is an analytical device having high detection sensitivity, but has the severe practical problem of the interference.

Moreover, excited molecule produced in plasma is a neutral particle and hence is not mass-separated in the mass analyzing part and reaches an electron multiplier. This excited molecule generates electron in the electron multiplier to cause production of noise. Thus, presence of the excited molecule is a serious obstacle to enhancement of sensitivity of plasma ion source mass spectrometer.

This is the same for MIPMS.

SUMMARY OF THE INVENTION

The object of the present invention is to efficiently quench the above-mentioned background ions and excited molecules, thereby to make it possible to detect elemental species which cannot be detected by the conventional techniques and furthermore to enhance sensitivity of plasma ion source mass spectrometer.

The above object can be attained by efficiently quenching the background ions and excited molecules before introduction of ions from ion source into mass analyzing part.

A sample introduced into plasma is ionized with plasma in plasma ion source mass spectrometer. Ion species produced in plasma includes, in addition to sample ions, various ions originating from argon, nitrogen, acid, water, etc. such as $Ar^{+}$, $Ar^{2+}$, $N^{2+}$, $ArO^{+}$, $O^{2-}$ +and the like and these ions other than the sample ions interfere with the ions to be detected (Table 1). Elements which are analyzed by plasma ion source mass spectrometer are usually metallic elements and elements such as C, Si, P, As, and S.

Normally, the background ions shown in Table 1 which interfere with the ions to be analyzed are in higher energy state than ions of elements to be analyzed. That is, ionization potential (IP) of components which interfere with the elements to be detected is higher than IP of the elements to be detected. For example, IP of Ar of m/z =40 is 15.8 eV while IP of Ca of m/z =40 is 6.1 eV. Further, IP of $N_2$ of m/z =28 is 15.6 eV while IP of Si of m/z =28 is 8.2 eV. Thus, there is a great difference in IP between the interfering (background) components and interfered elements.

It is possible to quench the background ions by utilizing the difference in IP. This theory will be explained below.

The interfering component is referred to as A, the interfered element to be analyzed is referred to as B and a molecule (the 3rd molecule) having an intermediate IP between that of A and that of B is referred to as C. When the 3rd neutral molecule C is allowed to be present in a gaseous phase where ions $A^+$and $B^+$coexist, the following charge transfer reaction occurs due to the difference in IP of A and that of C, the former being higher than the latter.

$$A^+ + C \rightarrow A + C^+ \quad (1)$$

Since IP of B is lower than that of C, even if $B^+$and C collide with each other, the charge transfer reaction does not occur. The ion-molecule charge transfer reaction as of the formula (1) is a very fast reaction with substantially no activation energy and besides no reverse reaction occurs. Therefore, ions present in the gaseous phase are $B^+$and $C^+$and ion $A^+$which interferes with ion $B^+$to be analyzed can be quenched. If $C^+$so that it has a mass to charge ratio (m/z) different from that of $B^+$, the peak appearing at the position of m/z of $B^+$is only the peak of $B^+$when mass-separated and detected in the mass analyzing part.

The 3rd molecule C may be any molecules having an intermediate IP between those of A and B. However, molecules having complicated molecular structure such as organic compounds may dissociate before they leave the plasma and reach the analyzing part, giving complicated mass spectrum and so molecules of as simple as possible are preferred.

In case of, for example, $N^{2+}$and $Si^+$which have m/z =28 and $Ar^+$and $Ca^+$which have m/z =40, Kr and Xe are effective as the 3rd molecules. IP and m/z of respective components are shown in Table 2.

TABLE 2

| | IP | m/z |
|---|---|---|
| Ar | 15.8 eV | 40 |
| $N_2$ | 15.6 eV | 28 |
| Kr | 14.0 eV | 78, 80, 82, 83, 84, 86 |
| Xe | 12.1 eV | 124, 126, 128, 129, 130, 131, 132, 134, 136 |
| Si | 8.2 eV | 28 |
| Ca | 6.1 eV | 40 |

From the above relation to IP, when Kr (or Xe) is allowed to be present in the mixture of $N^{2+}$and $Si^+$, only the following reaction (2) occurs and $N^{2+}$loses charge and hence only $Si^+$can be detected as the ion of m/z =28 in the mass analyzing part.

$$N^{2+} + Kr\ (\text{or } Xe) \rightarrow Kr^+ (\text{or } Xe^+) + N_2 \quad (2)$$

Similarly, in the case of the mixture of $Ar^+$and $Ca^+$, when Kr (or Xe) is allowed to be present, the following reaction (3) takes place and the background ion $Ar^{30}$ is quenched and thus only $Ca^+$can be detected at m/z =40.

$$Ar^+ + Kr(\text{or } Xe) \rightarrow Kr^+ (\text{or } Xe^+) + Ar \quad (3)$$

Generally, most of the elements to be detected by plasma ion source mass spectrometer have an IP lower than that of Xe. Furthermore, the background ions shown in Table 1 mostly have an IP higher than that of Xe. Accordingly, Xe is very effective to quench the background ions by charge transfer reaction for most of the elements to be analyzed by plasma ion source mass spectrometer. For Kr, some of interfering components may have an IP lower than that of Kr and in such case care should be taken.

According to this process, ions of the 3rd molecules are detected in place of the background ions of interfering components. That is, peaks of ions of the 3rd component appear at m/z =78, 80, 82, 83, 84, and 86 in case the 3rd component is Kr and at m/z =124, 126, 128, 129, 130, 131, 132, 134, and 136 in case the 3rd component is Xe. Therefore, elements to be detected with which $Kr^+$or $Xe^+$interferes must be taken into consideration, but these are $^{78}Se$, $^{80}Se$, etc. for Kr and $^{130}Te$, $^{133}Cs$, etc. for Xe and such elements are very few. $^{133}Cs$ does not meet with Xe in m/z, but is affected by $^{132}Xe$, $^{134}Xe$ in case resolution of mass spectrometer is low. However, even when elements with which Kr or Xe interferes are present in a sample, detection thereof can be attained by employing the conventional method which uses neither Xe nor Kr or by selecting other molecules (e.g., $CO_2$ and NO) as the 3rd molecule. Thus, there are no problems.

In order to effectively quench the background ions according to the reaction of the formula (1), it is important that there are many chances of the reaction of the formula (1) taking place. For this purpose, it is advantageous that probability of collision of background ion $A^+$and the 3rd molecule C is high, namely, partial pressure of the 3rd molecule component is high. In the plasma ion source mass spectrometer, ions produced at plasma ion source of 1 atm. are introduced into the mass analyzing part operated under a high vacuum of about $10^{-4}$ Pa and the reaction of the formula (1) is desirably allowed to take place in the area of low vacuum closer to the ion source side than to the mass analyzing part of high vacuum.

The method explained above which requires presence of a 3rd molecule is effective also for enhancing sensitivity of plasma ion source mass spectrometer. The plasma ion source mass spectrometer is a high-sensitivity mass spectrometer for elemental analysis. However, one difficulty for further enhancement of sensitivity is presence of excited molecule of plasma gas or carrier gas. Argon gas is ordinarily used as plasma gas or carrier gas. Ar is also present as excited argon particles ($Ar^*$) in plasma. This $Ar^*$ has a long life time and has no charge and hence reaches a detector such as channeltron or electron multiplier without being influenced by electric field or magnetic field, namely, without being mass separated. $Ar^*$ which reaches the detector generates secondary electron like ion and hence this secondary electron causes a noise at detection, resulting in much reduction of S/N ratio of detection. Thus, quenching of Ar* is very important for enhancement of sensitivity of plasma ion source mass spectrometer.

The aforementioned method using a 3rd molecule is also effective for quenching this Ar*. Energy of Ar* is 11.7 eV and if a 3rd molecule having an IP lower than it is called C, the 3rd molecule is ionized by the following reaction (4) and Ar* is in a ground state.

$$Ar^* + C \rightarrow C^+ Ar + e^- \quad (4)$$

Then, when a 3rd molecule C (for example, NO, IP =9.3 eV) which has an intermediate IP between that of the excited molecule Ar* and that of element B to be analyzed is allowed to be present, the excited molecule Ar* is quenched and as a result ion $B^+$ of element B to be analyzed is not affected by Ar and the 3rd molecule C. Ion $C^+$ of the 3rd molecule newly produced is mass separated and ion peak is given only at the position of m/z of C of this 3rd molecule. Therefore, noise caused by the excited molecule Ar* which may appear in the whole scanning region of m/z can be reduced and this is very effective for enhancement of sensitivity of plasma ion source mass spectrometer.

DESCRIPTION OF PREFERRED EMBODIMENTS

Figure 1:
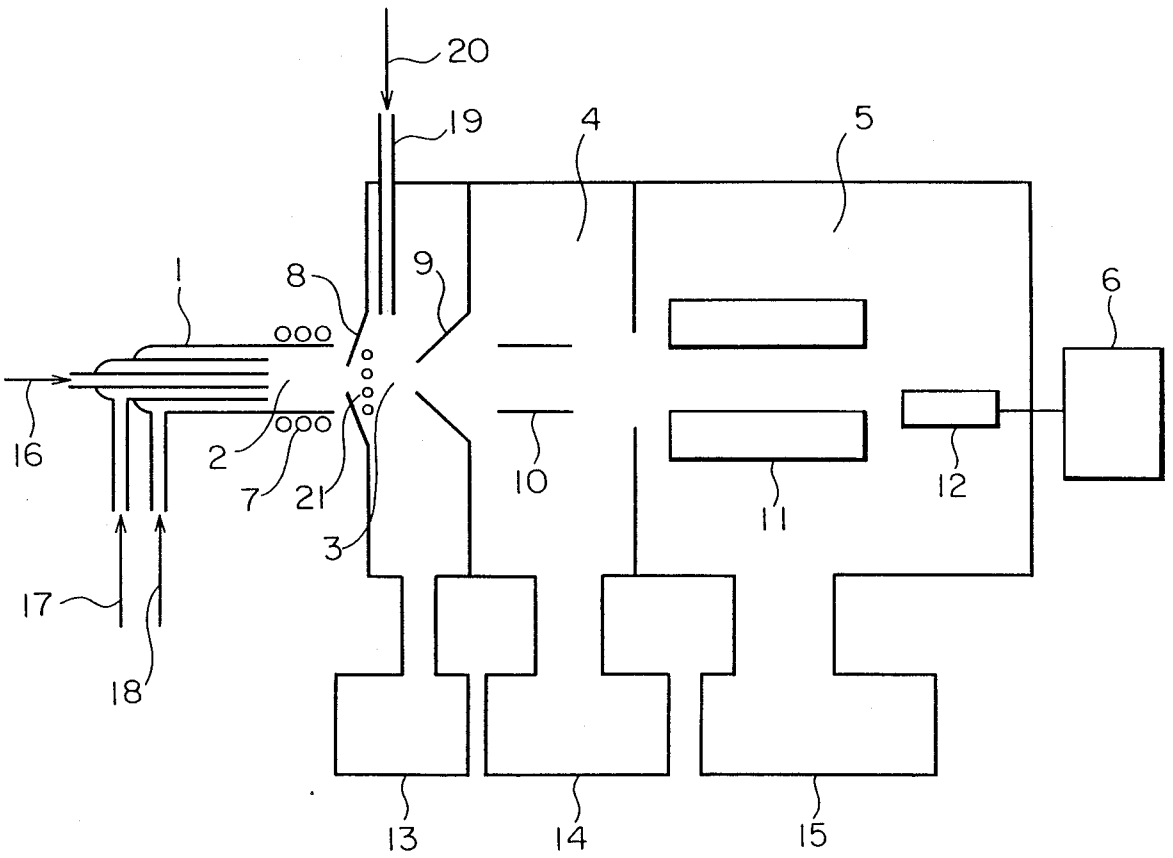
FIG. 1 is a block diagram of the plasma ion source mass spectrometer which is one example of the present invention.

Examples of the present invention will be explained below referring to the drawings.

FIG. 1 shows outline of construction of plasma ion source mass spectrometer which is one example of the present invention. In FIG. 1, sample to be analyzed is dissolved in a solvent and then is nebulized by a nebulizer (ultrasonic nebulizer, atomizer, etc.) and introduced into ion source 1 together with a carrier gas (argon, nitrogen, etc.) as nebular sample 16. Simultaneously, into ion source 1 are introduced plasma gas 18 (argon, nitrogen, etc.) and auxiliary gas 17 (argon, nitrogen, etc.). Plasma is produced in plasma area 2 by excitation with high-frequency coil 7 under 1 atm. In the plasma, there are produced ions of element to be analyzed and ions originating from the plasma gas, the carrier gas, the auxiliary gas, water for dissoving the sample, acid, and impurities in the gases (the background ions shown in Table 1). The background ions are produced in much greater amount than the ion of element to be analyzed. These ions are introduced into first differential pumping region 3 through the aperture of first aperture electrode 8. The first differential pumping region is under reduced pressure by evacuation pump 13.

In conventional plasma ion source mass spectrometer, ions produced in the plasma are introduced into mass analyzing part 5 through the first differential pumping region 3 and the second differential pumping region 4 and efficiently introduced into mass spectrometer 11 by extraction electrode 10, where they are subjected to mass separation. The separated ions are detected by electron multiplier 12 and the results are recorded in recording part 6. The first differential pumping region 4 and analyzing part 5 are evacuated by evacuation pump 14 and evacuation pump 15, respectively. Mass spectrometer 11 separates ions according to mass to charge ratio (m/z) of ions and so a plurality of ions having the same m/z value, even if they are different ion species, cannot be separated from each other. Therefore, ions of elements to be analyzed which have the same m/z value as that of background ions produced in the ion source cannot be separated from the background ions and so cannot be detected.

In order to solve the above problem, according to the present invention, gas having intermediate ionization potential (IP) between that of elemental ions and that of background ions (intermediate IP gas 20) is introduced into the first differential pumping region 3 through gas introduction pipe 19. As the intermediate IP gas, there may be selected a gas having an intermediate IP between that of background ions and that of the element to be analyzed. In plasma ionization method where argon or nitrogen is used as a plasma gas, xenon gas and cryptone gas are effective as the intermediate IP gas 20.

The background ions are quenched by allowing the reaction of the formula (1) to take place in the differential pumping region 3. In order to efficiently quench the background ions, it is important to raise the partial pressure of the intermediate IP gas component in region 3 to increase probability of collision between the background ions and the intermediate IP gas molecule. The partial pressure of the intermediate IP gas can be raised by increasing the amount of intermediate IP gas 20 introduced. In this case, much increase of the amount provides a problem when an expensive gas such as xenon is employed. However, practically, this is not so severe problem because at most 1000 sccm (1 l/min under 1 atm) is sufficient as the amount of the gas introduced in the present invention. Completely ignoring the price, background ions originating from at least Ar can be quenched if xenon gas is used in place of argon gas for all of plasma gas 18, auxiliary gas 17, and carrier gas for sample. Thus, this is effective. However, amount of gas used in the conventional plasma ion source mass spectrometer is at least 10000 sccm (10 l/min under 1 atm) and besides, it is necessary to allow the gas to pass for a long time for stabilization of plasma as well as for analysis. Therefore, use of xenone gas in place of argon gas is practically very difficult. On the other hand, amount of the intermediate IP gas required in the present invention is less than 1/10 the amount required in the conventional technique and besides, the gas may be introduced only for the analysis and so amount of the necessary intermediate IP gas further decreases.

In order to further reduce the amount of the intermediate IP gas to be introduced, the following consideration is also taken. That is, in order to increase density of intermediate IP gas in ion orbit in region 3, amount of gas evacuated by pump 13 is reduced and amount of gas passing through second aperture electrode 9 is increased, whereby amount of intermediate IP gas molecule passing through the aperture of second aperture electrode is increased and so probability of collision between ions and the intermediate IP gas molecule in the vicinity of the aperture increases. Thus, amount of intermediate IP gas to be introduced can be reduced without reducing the probability of collision.

Figure 2:
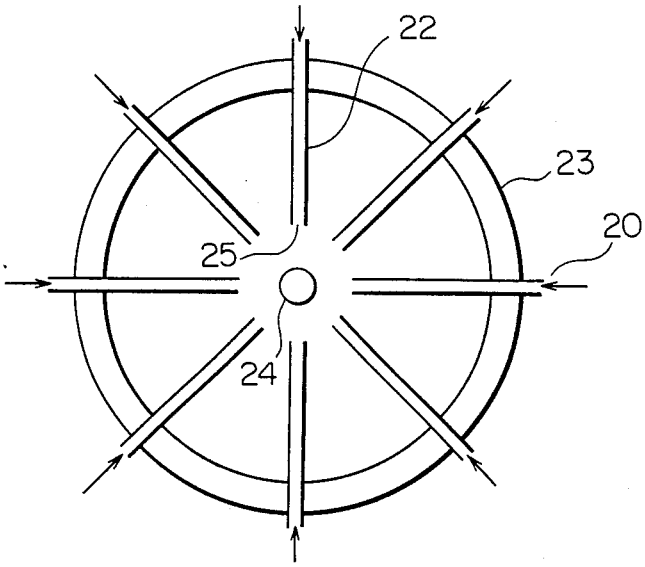
FIGS. 2 and 3 are schematic cross-sectional views of gas introduction mechanisms which are different examples according to the present invention.
Figure 3:
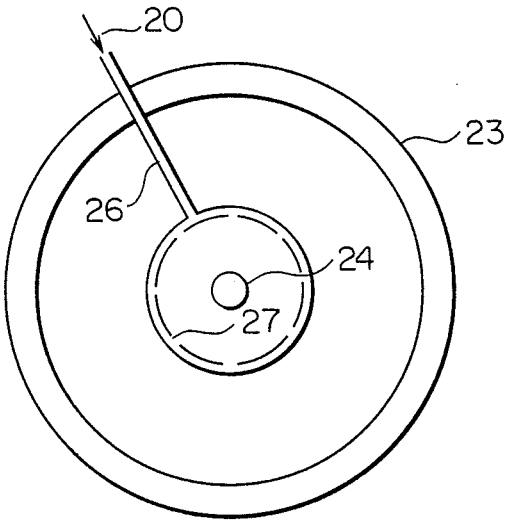

Furthermore, it is desired for improvement of density of intermediate IP gas molecule in the ion orbit to introduce the intermediate IP gas against the ion orbit. In this case, introduction of the intermediate IP gas from only one direction disturbs the ion orbit and hence the intermediate IP gas is uniformly introduced from circumference of the ion orbit. A gas introduction mechanism suitable for the plasma ion source mass spectrometer of the present invention is shown in FIGS. 2 and 3. Intermediate IP gas 20 is introduced from intermediate IP gas introduction pipes 22 and 26. By employing the intermediate IP gas introduction pipes having the constructions as shown in FIGS. 2 and 3, intermediate IP gas 20 is uniformly introduced toward the center of ion beam from openings 25 and 27 of the introduction pipes uniformly provided on the circumference of ion orbit (ion beam) 24 in vacuum chamber 23.

Furthermore, according to the example as shown in FIG. 1, potential difference can be set between electrode 8 and electrode 9 to reduce disturbance of ion orbit. By setting the potential at electrode 9 to be lower than the potential at electrode 8, ions are accelerated in the direction of electrode 9 and besides, ions are converged to the aperture of electrode 9 owing to the conical shape of electrode 9. Therefore, flow of neutral molecule may be disturbed by the introduction of intermediate IP gas molecule, but flow of ion is not disturbed much.

Intermediate IP gas molecule of ground state is necessary in order that the charge transfer reaction [the formula (1)]between the background ions and intermediate IP gas molecule occurs in region 3. Electrons introduced together with ions and neutral molecule into region 3 from plasma are cooled due to adiabatic expansion, but sometimes may not be sufficiently cooled depending on the pressure in region 3. In case the intermediate IP gas molecule is ionized by the electrons, the reaction of the formula (1) does not take place. In order to remove this difficulty, mesh electrode 21 can be provided in the example shown in FIG. 1. Negative potential is set at the mesh electrode 21 and this mesh electrode 21 allows permeation of ion, but not electron. Entering of electron into region 3 can be inhibited by introducing intermediate IP gas behind the mesh electrode 21 and thus ionization of intermediate IP gas molecule by electron can be reduced. This mesh electrode 21 may be not only in the form of mesh, but also in the form of cylinder. Further, instead of using this electrode, electron may be repulsed by setting a potential difference between electrode 8 and electrode 9.

In the region 3 having the above-mentioned construction, excited molecule (for example, Ar*) which is produced in the plasma and is a noise source upon reaching the electron multiplier 12 can be efficiently quenched. That is, the excited molecule introduced into plasma from region 3 reacts with the intermediate IP gas 20 as shown by the formula (4) and is in ground state.

As explained above, after quenching the background ions and excited molecule in region 3, ion of the element to be analyzed is introduced into analyzing part 5 through second differential pumping region 4 and mass separated in mass spectrometer 11, reaches electron multiplier 12 and is detected. Thus, according to the present invention, kind of elements which can be analyzed increases and so scope for application of the plasma ion source mass spectrometer can be much extended. Furthermore, noise can be reduced and sensitivity can be enhanced. These are important effects of the present invention.

Figure 4:
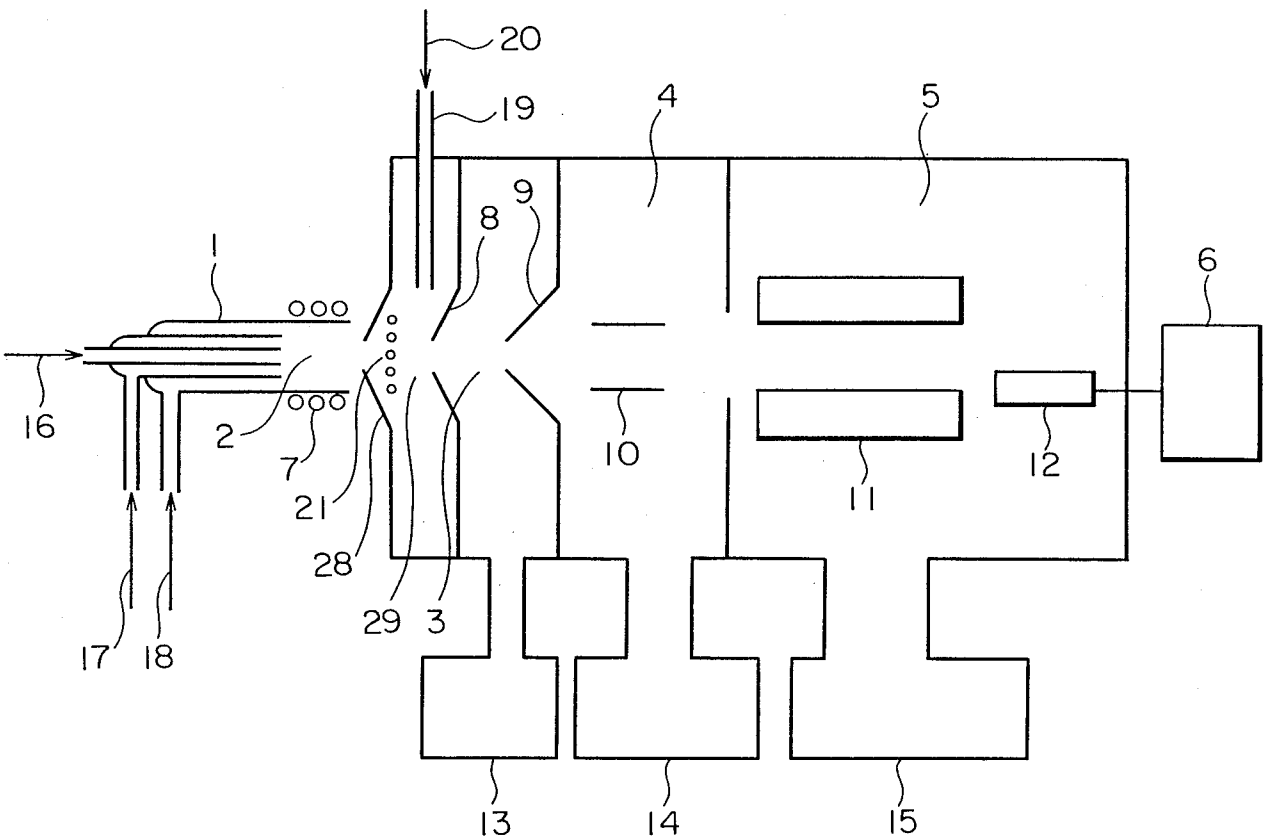
FIGS. 4–8 are block diagrams of plasma ion source mass spectrometers which are different examples of the present invention.

FIG. 4 shows another example of the present invention.

This example is fundamentally the same as that of FIG. 1 except that collision region 29 is provided to increase probability of collision between ion and intermediate IP gas molecule.

Collision region 29 is formed of aperture electrode 28 and first aperture electrode 8, but an evacuation pump is not connected thereto and vacuum state is attained only by evacuation from aperture of the first aperture electrode 8. Owing to this construction, all of the intermediate IP gas introduced into the collision region 29 from intermediate IP gas introduction pipe 19 passes through the aperture of the first aperture electrode 8. Therefore, chances of contacting of ion beam with the intermediate IP gas increase to enhance probability of collision between ion and intermediate IP gas molecule and that of collision between excited neutral molecule and intermediate IP gas molecule. Thus, background ions and excited neutral molecule can be more effectively quenched. In addition, amount of the intermediate IP gas introduced can also be reduced.

In this example, intermediate IP gas introduction pipes 22 and 26 and mesh electrode 21 shown in FIGS. 2 and 3 can also be provided as in FIG. 1. Furthermore, potential difference can be set between aperture electrode 28 and the first aperture electrode 8 for the same purpose as in FIG. 1.

Figure 5:
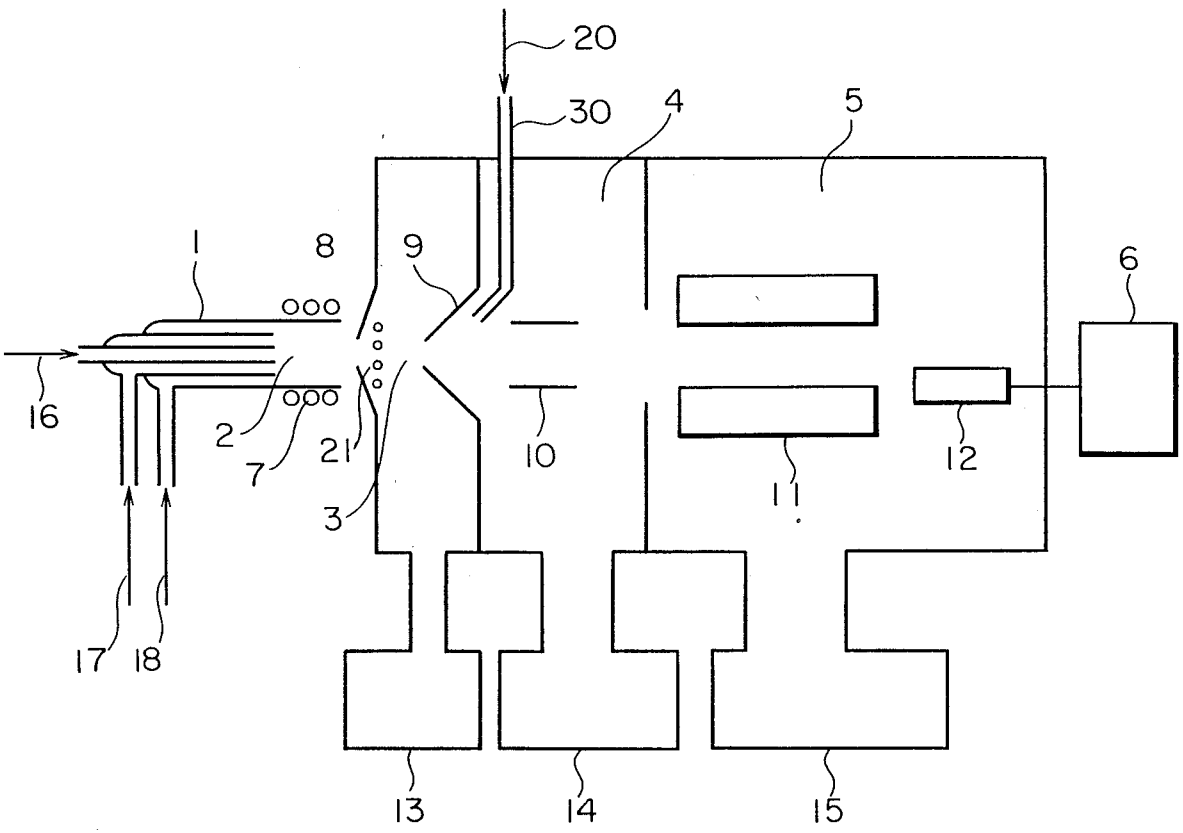

FIG. 5 shows another example of the present invention.

This example of FIG. 5 is the same as of FIG. 1 in that the intermediate IP gas molecule is allowed to collide with background ions and excited molecule, but in this example intermediate IP gas 20 is introduced into second differential pumping region 4 from intermediate IP gas introduction pipe 30.

Since pressure in region 4 is set to be lower than that in region 3, density of particles introduced from plasma is lower in second differential pumping region 4 than in first differential pumping region 3. That is, particles (ion, electron, neutral molecule) which have passed through the aperture of second aperture electrode 9 are further diffused in the second differential pumping region 4 than in the first differential pumping region 3. At this time, particles other than ions may be diffused, but if ions are diffused, amount of ions introduced into spectrometer 11 decreases and so the diffusion of ions is reduced by extraction electrode 10 applied with a negative potential. When intermediate IP gas 20 is introduced in the vicinity of the aperture of second aperture electrode 9, particle density in this part is lower than in the first differential pumping region 3 and so the intermediate IP gas molecule is more easily diffused in the ion orbit than when it is introduced into the first differential pumping region 3 and thus partial pressure of the intermediate IP gas necessary to quench the background ions in the ion orbit can be easily obtained. In this case, however, since pressure in region 4 is lower than that in region 3, the intermediate IP gas per se introduced into region 4 rapidly diffuses to the surroundings. Therefore, the gas discharging opening of intermediate IP gas introduction pipe 30 is in the form of sufficiently thin nozzle whereby diffusion of the intermediate IP gas discharged from this nozzle before reaching the ion orbit can be reduced.

As evacuation pumps 14 and 15 may be used those pumps which have evacuation ability to inhibit increase of pressure in analyzing part 5 cased by the intermediate IP gas introduced. Furthermore, the intermediate IP gas is introduced in the vicinity of the aperture of the second aperture electrode in region 4 and a sharp pressure gradient is set between the vicinity of the aperture of second aperture electrode 9 in region 4 and the part close to analyzing part 5. Thereby, increase of pressure in analyzing part 5 is inhibited and the number of collision between the intermediate IP gas molecule and ion is increased.

Figure 6:
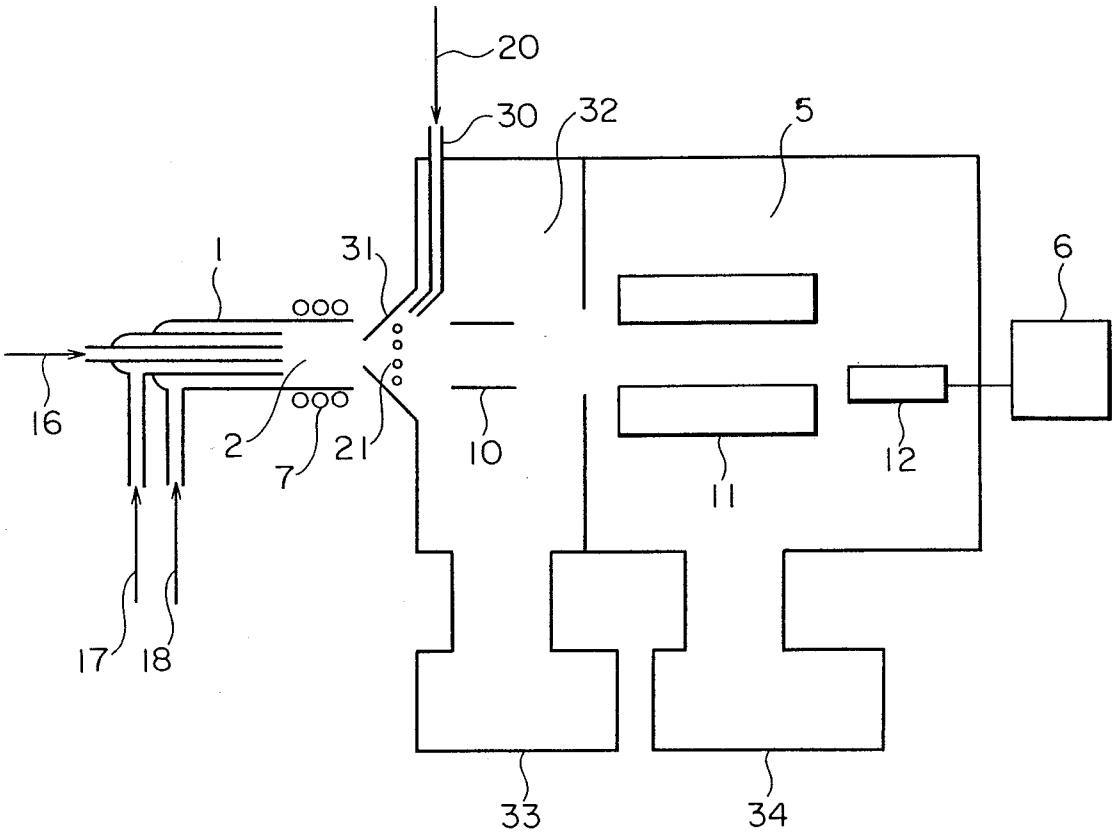

FIG. 6 also shows another example of the present invention.

Examples of FIGS. 1, 4 and 5 are plasma ion source mass spectrometers having a plurality of differential pumping regions to which the present invention are applied. On the other hand, the example of FIG. 6 shows application of the present invention to a plasma ion source mass spectrometer having one differential pumping region. When evacuation capability of evacuation pumps 33 and 34 are enhanced, degree of vacuum in analyzing part 5 can be maintained at a pressure proper for operation of spectrometer 11 and electron multiplier 12 even by one step differential evacuation through aperture electrode 31. By introducing intermediate IP gas 20 into differential pumping region 32, background ions and excited neutral molecule can be efficiently quenched as in FIG. 1.

Figure 7:
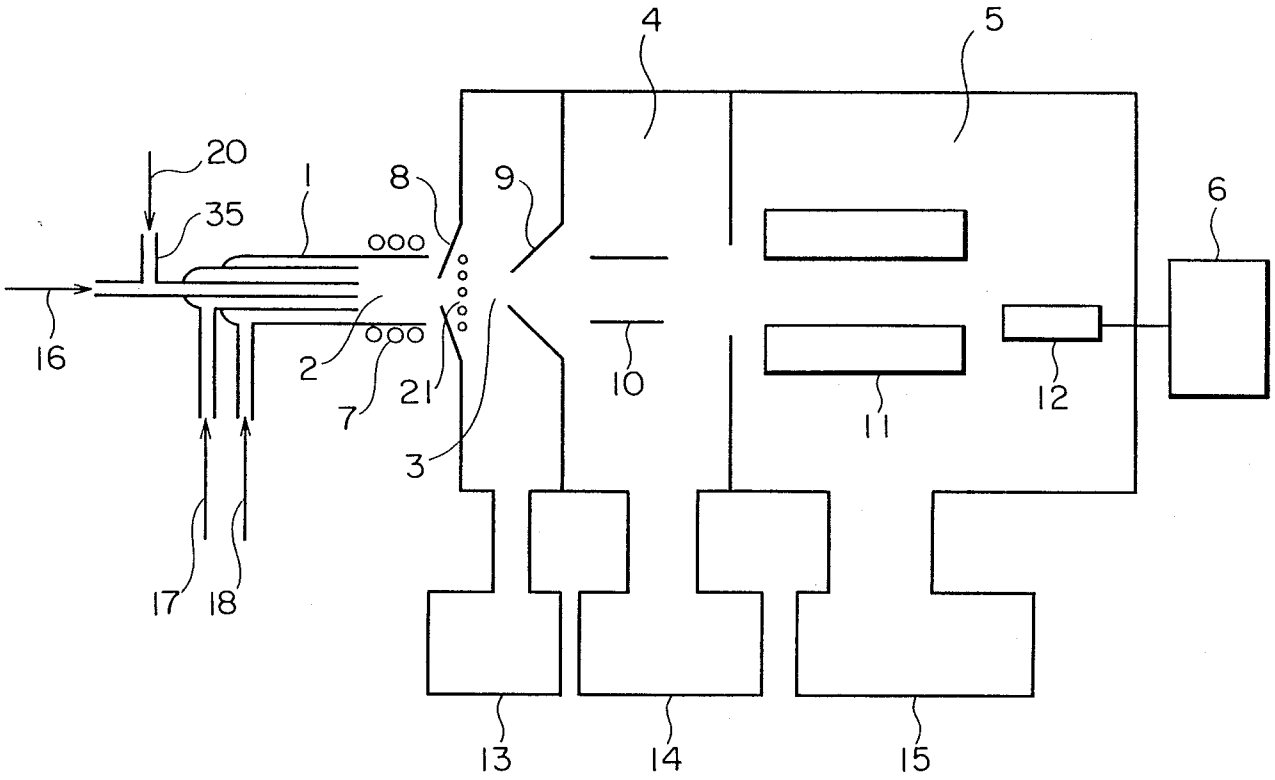

FIG. 7 also shows another example of the present invention.

In the examples of FIGS. 1 and 4–6 intermediate IP gas 20 is introduced into the connecting portion of plasma ionization part 1 and analyzing part 5 while the intermediate IP gas is introduced into plasma formation part 2 in this example.

The plasma gas 18 (Ar, $N_2$ or the like) has an ionization degree of about 0.1% in plasma and is mostly present as neutral molecule. Xe or Kr as intermediate IP gas 20 introduced into the plasma also has the similar ionization degree to that of the plasma gas. Therefore, taking the case of Ar and Xe, $Ar^+$ as a background ion is quenched in the plasma in accordance with the following reaction (5):

$$Ar^+ + Xe \rightarrow Ar + Xe^+ \quad (5)$$

However, Ar which has become neutral is immediately converted to $Ar^+$ by the electron in plasma and so quenching of $Ar^+$ in plasma is difficult.

Therefore, in this example, the background ions are quenched by charge transfer reaction in the first differential pumping region 3. Most of the intermediate IP gas introduced into region 3 from plasma forming part 2 through the aperture of the first aperture electrode 8 is in the form of neutral particles. Charge transfer reaction takes place between the neutral particles of the intermediate IP gas and the background ions introduced into region 3 and the background ions lose charge. Electrons simultaneously introduced into region 3 are cooled by adiabatic expansion and hence do not reionize the background molecule formed by losing charge. In case the electrons are not sufficiently cooled due to the pressure of region 3, the electrons can be prevented from entering region 3 by setting potential difference between mesh electrode 21 or the first aperture electrode 8 and the second aperture electrode 9 as in the example of FIG. 1.

In FIG. 7, intermediate IP gas 20 is introduced into the introduction part of sample and carrier gas through intermediate IP gas introduction pipe 35, but may also be introduced into plasma as a mixture with auxiliary gas 17 and plasma gas 18 to obtain the same effect.

In this example, it is not necessary to provide a gas introduction mechanism at the portion connecting ion source and mass spectrometer and so there is the advantage that only a little reconstruction of hardware is needed.

Figure 8:
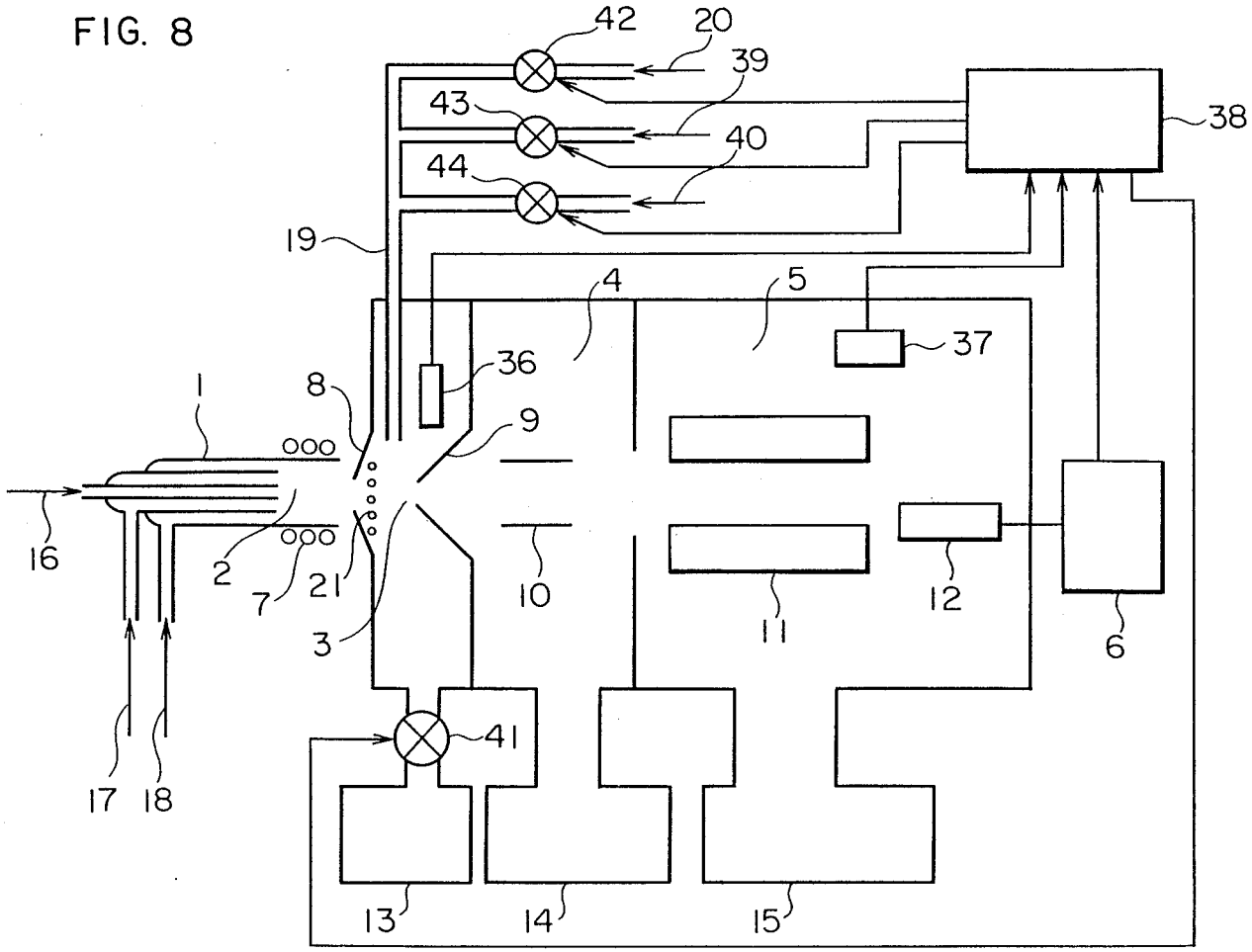
Figure 9:
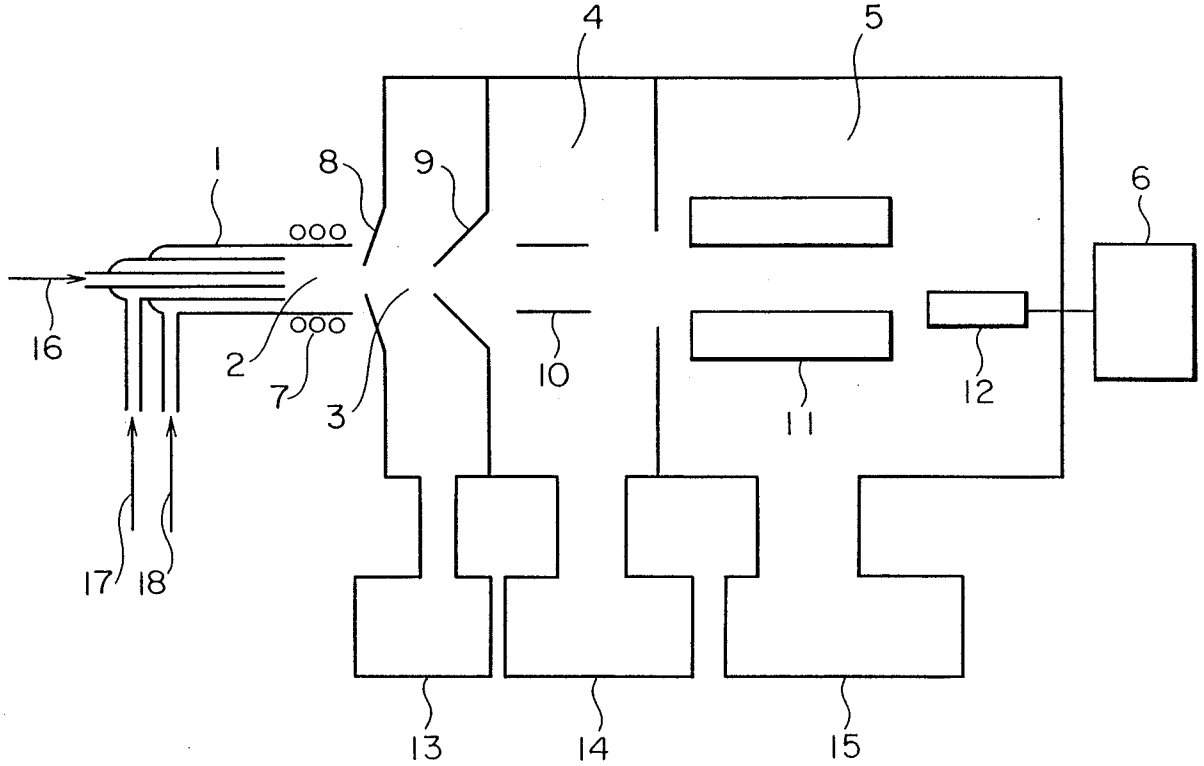
FIG. 9 is a block diagram of a conventional plasma ion source mass spectrometer.

FIG. 8 shows another example of the present invention. In this example, automatic control of introduction of intermediate IP gas is effected in the construction of FIG. 1.

In order to quench the background ions or excited molecule by introducing intermediate IP gas, it is necessary to select an intermediate IP gas optimum considering from the relation between IP of plasma gas, carrier gas and auxiliary gas and IP of the element to be analyzed. In this example, a plurality of intermediate IP gases 20, 39, and 40 can be selectively introduced for intermediate IP gas introduction pipe 19. When an operator determines the kind of intermediate IP gas in controlling mechanism 38, this controlling mechanism 38 opens the selected valve among valves 42–44 to introduce only the selected intermediate IP gas into region 3.

Furthermore, in order to reduce unnecessary consumption of expensive gas such as xenone, valves 42–44 are controlled by controlling mechanism 38 so that the spectra obtained in recording part 6 are transmitted to controlling mechanism 38 and intermediate IP gas in the minimum amount for quenching of background ions is introduced into region 3. Pressure in region 3 is monitored by vacuum gauge 36 and the result is used for control of the pressure in region 3.

Moreover, for effective utilization of the introduced intermediate IP gas, control of evacuation by evacuation pump 13 is carried out by controlling valve 41 by control mechanism 38. In this case, too, under observation of spectra in recording part 6, optimum amount of evacuation by pump 13 and optimum introduction amount of intermediate IP gas are controlled by valve 41 and valves 42–44 by control mechanism 38, respectively.

Further, vacuum gauge 37 is provided in order to prevent rise of pressure in analyzing part 5 over the pressures under which mass spectrometer 11 and electron multiplier 12 can be operated, which may occur due to the introduction of intermediate IP gas. Results of monitoring by vacuum gauge 37 are always input in controlling mechanism 38 and depending on the results valve 41 and valves 42–44 are controlled by controlling mechanism 38.

According to this example, control of optimum introduction amount of intermediate IP gas, selection of intermediate IP gas and control of degree of vacuum are automatically carried out. Therefore, there are great effects of curtailment of complicated operation, reduction of cost by avoiding use of superfluous gas and inhibition of troubles in device due to oeprational mistake.

According to the present invention, background ions and excited molecules produced in plasma which cause serious defects for conventional plasma ion source mass spectrometer can be efficiently quenched. Therefore, there are obtained very great effects that scope of application can be extended owing to increase of kinds of elements which can be analyzed and performances can be improved due to enhancement of sensitivity.

We claim:

1. A plasma ion source mass spectrometer comprising an ion source in which a sample to be detected is ionized with plasma and a mass spectrometer which mass-separates and detects the ionized sample supplied from the ion source wherein a gas introduction means is provided for introducing into a region before the mass spectrometer a gas containing particles which can bring about a charge transfer reaction with background ions contained in particles supplied from the ion source.

2. A plasma ion source mass spectrometer according to claim 1, wherein the gas introduction means is constructed so that the gas is introduced into a part connecting the ion source and the mass spectrometer.

3. A plasma ion source mass spectrometer according to claim 1, wherein the gas introduction means is constructed so that the gas is introduced into the ion source.

4. A plasma ion source mass spectrometer according to claim 2, wherein a region is provided where gas particles introduced into the a part connecting the ion source and the mass spectrometer by the gas introduction means collide with the particles from the ion source.

5. A plasma ion source mass spectrometer according to claim 1, wherein a means to prevent release of electron is provided at exit of the ion source.

6. A plasma ion source mass spectrometer according to claim 1, wherein the gas introduction means has a means to control the introduction amount of the gas.

7. A plasma ion source mass spectrometer according to claim 6, wherein an evacuation amount controlling means is provided in a differential pumping region of the mass spectrometer.

8. A plasma ion source mass spectrometer according to claim 7, wherein the introduction amount controlling means and the evacuation amount controlling means are automatically controlled to control collision of the particles of the gas with the gas from said ion source.

9. A plasma ion source mass spectrometer according to claim 1, wherein gas introduction mechanism used for the gas introduction means comprises nozzles for introducing the gas which are provided at a plurality of positions in the circumferential direction of the flow of particles introduced into the mass spectrometer from the ion source.

10. A plasma ion source mass spectrometer comprising an ion source in which a sample to be detected is ionized with plasma and a mass spectrometer which mass-separates and detects the ionized sample supplied from the ion source wherein a gas introduction means is provided for introducing into a region before the mass spectrometer a gas containing particles which can bring about an energy transfer reaction with excited molecule contained in particles supplied from the ion source.

11. A plasma ion source mass spectrometer according to claim 10, wherein the gas introduction means is constructed so that the gas is introduced into a part connecting the ion source and the mass spectrometer.

12. A plasma ion source mass spectrometer according to claim 10, wherein the gas introduction means is constructed so that the gas is introduced into the ion source.

13. A plasma ion source mass spectrometer according to claim 11, wherein a region is provided where gas particles introduced into a part connecting the ion source and the mass spectrometer by the gas introduction means collide with the particles from the ion source.

14. A plasma ion source mass spectrometer according to claim 10, wherein a means to prevent escape of electron is provided at exit of the ion source.

15. A plasma ion source mass spectrometer according to claim 10, wherein the gas introduction means has a means to control the introduction amount of the gas.

16. A plasma ion source mass spectrometer according to claim 15, wherein an evacuation amount controlling means is provided in a differential pumping region of the mass spectrometer.

17. A plasma ion source mass spectrometer according to claim 16, wherein the introduction amount controlling means and the evacuation amount controlling means are automatically controlled to control collision of the particles of the gas with the gas from said ion source.

18. A plasma ion source mass spectrometer according to claim 10, wherein gas introduction mechanism used for the gas introduction means comprises nozzles for introducing the gas which are provided at a plurality of positions in the circumferential direction of the flow of particles introduced into the mass spectrometer from the ion source.

19. A plasma ion source mass spectrometer comprising an ion source in which a sample is ionized with plasma and a mass spectrometer which mass-separates and detects particles supplied from the ion source in which is provided a means to allow the particles supplied from the ion source to collide with particles which can remove charge from background ions other than the ions to be detected among the particles supplied from the ion source.

20. A plasma ion source mass spectrometer according to claim 19, wherein the particles which can remove charge are those which have an intermediate ionization potential between that of the ions to be detected and that of the background ions.

21. A plasma ion source mass spectrometer comprising an ion source in which a sample is ionized with plasma and a mass spectrometer which mass-separates and detects particles supplied from the ion source in which is provided a means to allow the particles supplied from the ion source to collide with particles which can remove energy from excited particles other than the ions to be detected among the particles supplied from the ion source.

22. A plasma ion source mass spectrometer according to claim 21, wherein the particles which can remove energy are those which have an intermediate ionization potential between energy of the excited particles and ionization potential of the ions to be detected.

* * * * *